US011296443B2

(12) United States Patent
Han et al.

(10) Patent No.: US 11,296,443 B2
(45) Date of Patent: Apr. 5, 2022

(54) CONNECTOR COMPRISING METAL PLATE AND ELECTRONIC DEVICE COMPRISING SAME

(71) Applicant: Samsung Electronics Co., Ltd., Gyeonggi-do (KR)

(72) Inventors: Jaeryong Han, Gyeonggi-do (KR); Inha Lee, Gyeonggi-do (KR); Hanseok Mun, Gyeonggi-do (KR)

(73) Assignee: Samsung Electronics Co., Ltd

( * ) Notice: Subject to any disclaimer, the term of this patent is extended or adjusted under 35 U.S.C. 154(b) by 0 days.

(21) Appl. No.: 16/966,651

(22) PCT Filed: Feb. 20, 2019

(86) PCT No.: PCT/KR2019/002003
§ 371 (c)(1),
(2) Date: Jul. 31, 2020

(87) PCT Pub. No.: WO2019/164224
PCT Pub. Date: Aug. 29, 2019

(65) Prior Publication Data

US 2021/0036451 A1 Feb. 4, 2021

(30) Foreign Application Priority Data

Feb. 23, 2018 (KR) ..... 10-2018-0021786

(51) Int. Cl.
*H01R 12/71* (2011.01)
*H01R 13/627* (2006.01)

(52) U.S. Cl.
CPC ..... *H01R 12/716* (2013.01); *H01R 13/627* (2013.01)

(58) Field of Classification Search
CPC ..... H01R 12/7076; H01R 12/7082; H01R 12/707; H01R 12/712; H01R 12/716; H01R 12/73; H01R 13/627
See application file for complete search history.

(56) References Cited

U.S. PATENT DOCUMENTS 6,923,661 B1 8/2005 Bogiel et al.
9,728,882 B1 8/2017 Nakazawa
(Continued)

FOREIGN PATENT DOCUMENTS

CN 103367978 10/2013
CN 206059842 3/2017
(Continued)

OTHER PUBLICATIONS

European Search Report dated Feb. 11, 2021 issued in counterpart application No. 19757511.1-1201, 10 pages.
(Continued)

*Primary Examiner* — Oscar C Jimenez
(74) *Attorney, Agent, or Firm* — The Farrell Law Firm, P.C.

(57) ABSTRACT

An electronic device according to one embodiment of the present invention comprises: a connector; and a printed circuit board on which the connector is mounted, wherein the connector is a non-conductive structure comprising: a plate including a first surface and a second surface facing and opposed to the first surface; a first sidewall perpendicular to the plate; a second sidewall perpendicular to the first side wall and the plate; a third sidewall perpendicular to the first sidewall and the plate and parallel to the second sidewall; a fourth sidewall perpendicular to the plate and parallel to the first sidewall, wherein the first surface of the plate, the first sidewall, the second sidewall, the third sidewall, and the fourth sidewall form a recess in the structure; a plurality of conductive terminals coupled to the
(Continued)

second and third sidewalls and electrically connected to the printed circuit board; and a metallic plate for covering at least one side of the first sidewall or the fourth sidewall, wherein the first sidewall or the fourth sidewall comprises: a third surface forming the recess; a fourth surface facing and opposed to the third surface; a sixth surface forming the backside of the structure together with the second surface; and a fifth surface facing and opposed to the sixth surface, wherein the metallic plate may cover the third surface and the fifth surface. Various other embodiments are possible.

14 Claims, 11 Drawing Sheets

(56) References Cited

U.S. PATENT DOCUMENTS

| | | | | |
|---|---|---|---|---|
| 9,887,473 | B2 * | 2/2018 | Lee | H01R 12/716 |
| 9,899,771 | B2 * | 2/2018 | Ashibu | H01R 12/716 |
| 9,985,366 | B2 * | 5/2018 | Takeuchi | H01R 12/00 |
| 10,003,148 | B2 * | 6/2018 | Ashibu | H01R 13/2492 |
| 10,446,985 | B2 * | 10/2019 | Ooi | H01R 13/6585 |
| 10,868,378 | B2 * | 12/2020 | Ko | H01R 12/707 |
| 10,950,980 | B2 * | 3/2021 | Sunaga | H01R 13/6591 |
| 2006/0264075 | A1 | 11/2006 | Obikane et al. | |
| 2013/0280926 | A1 | 10/2013 | Ono | |
| 2015/0263464 | A1 * | 9/2015 | Arichika | H01R 13/6275 439/374 |
| 2015/0303597 | A1 | 10/2015 | He et al. | |
| 2017/0264048 | A1 | 9/2017 | Ashibu et al. | |
| 2018/0277972 | A1 | 9/2018 | Takeuchi et al. | |
| 2020/0395704 | A1 * | 12/2020 | Hosoda | H01R 12/716 |

FOREIGN PATENT DOCUMENTS

| | | |
|---|---|---|
| JP | 4478609 | 6/2010 |
| JP | 2015220005 | 12/2015 |
| JP | 2018-018838 | 2/2018 |
| KR | 101656514 | 9/2016 |
| KR | 1020160118141 | 10/2016 |
| KR | 1020160126894 | 11/2016 |
| KR | 1020170127305 | 11/2017 |
| KR | 1020170127996 | 11/2017 |
| KR | 1020170128079 | 11/2017 |

OTHER PUBLICATIONS

PCT/ISA/210 Search Report issued on PCT/KR2019/002003, dated Jun. 7, 2019, pp. 5.

PCT/ISA/237 Written Opinion issued on PCT/KR2019/002003, dated Jun. 7, 2019, pp. 5.

Chinese Office Action dated Oct. 11, 2021 issued in counterpart application No. 201980014851.2, 16 pages.

* cited by examiner

CONNECTOR COMPRISING METAL PLATE AND ELECTRONIC DEVICE COMPRISING SAME

PRIORITY

This application is a National Phase Entry of International Application No. PCT/KR2019/002003, which was filed on Feb. 20, 2019, and claims priority to Korean Patent Application No. 10-2018-0021786, filed in the Korean Intellectual Property Office on Feb. 23, 2018, the content of each of which is incorporated herein by reference.

TECHNICAL FIELD

The disclosure relates to a connector including a metal plate and an electronic device including the same.

BACKGROUND ART

As digital technologies have developed, electronic devices have been provided in various forms such as smartphones, tablet personal computers (PCs), or personal digital assistants (PDAs). The electronic devices have been developed to be mounted on users so as to improve portability and accessibility of the users. The electronic devices may include a socket connector and a header connector for electrically connecting electronic components.

DISCLOSURE OF INVENTION

Technical Problem

An impact or a load applied to a header connector and a socket connector when the two connectors are coupled to each other may damage the header connector and/or the socket connector. The structure of the connector, to which conductive terminals are coupled, is formed of a material such as a plastic resin, and thus may be vulnerable to damage. Further, if the header connector and the socket connector are coupled in a state in which the connectors are not precisely arranged, the connector may be damaged at a higher possibility.

Various embodiments of the disclosure may provide a connector including a metal plate for preventing damage to a header connector and a socket connector when the two connectors are coupled to each other, and an electronic device including the same.

Solution to Problem

In accordance with an aspect of the disclosure, there is provided an electronic device including a connector, and a printed circuit board, on which the connector is mounted, wherein the connector includes a nonconductive structure including a plate including a first surface and a second surface facing a side that is opposite to a side which the first surface faces, a first side wall that is perpendicular to the plate, a second side wall that is perpendicular to the first side wall and the plate, a third side wall that is perpendicular to the first side wall and the plate and is parallel to the second side wall, and a fourth side wall that is perpendicular to the plate and is parallel to the first side wall, and having a recess defined by the first surface of the plate, the first side wall, the second side wall, the third side wall, and the fourth side wall, a plurality of conductive terminals coupled to the second side wall and the third side wall and electrically connected to the printed circuit board, and a metal plate configured to cover at least one surface of the first side wall or the fourth side wall, wherein the first side wall or the fourth side wall includes a third surface defining the recess, a fourth surface facing a side that is opposite to a side which the third surface faces, a sixth surface defining a rear surface of the structure together with the second surface, and a fifth surface facing a side that is opposite to a side which the sixth surface faces, and wherein the metal plate covers the third surface and the fifth surface.

Advantageous Effects of Invention

According to various embodiments of the disclosure, because an impact or a load applied to the structure can be reduced by the metal members that cover portions of the structures of the connectors, which are formed of a material such as a plastic resin when the header connector and the socket connector area coupled to each other, damage to the structures can be prevented.

BEST MODE FOR CARRYING OUT THE INVENTION

Figure 1A:
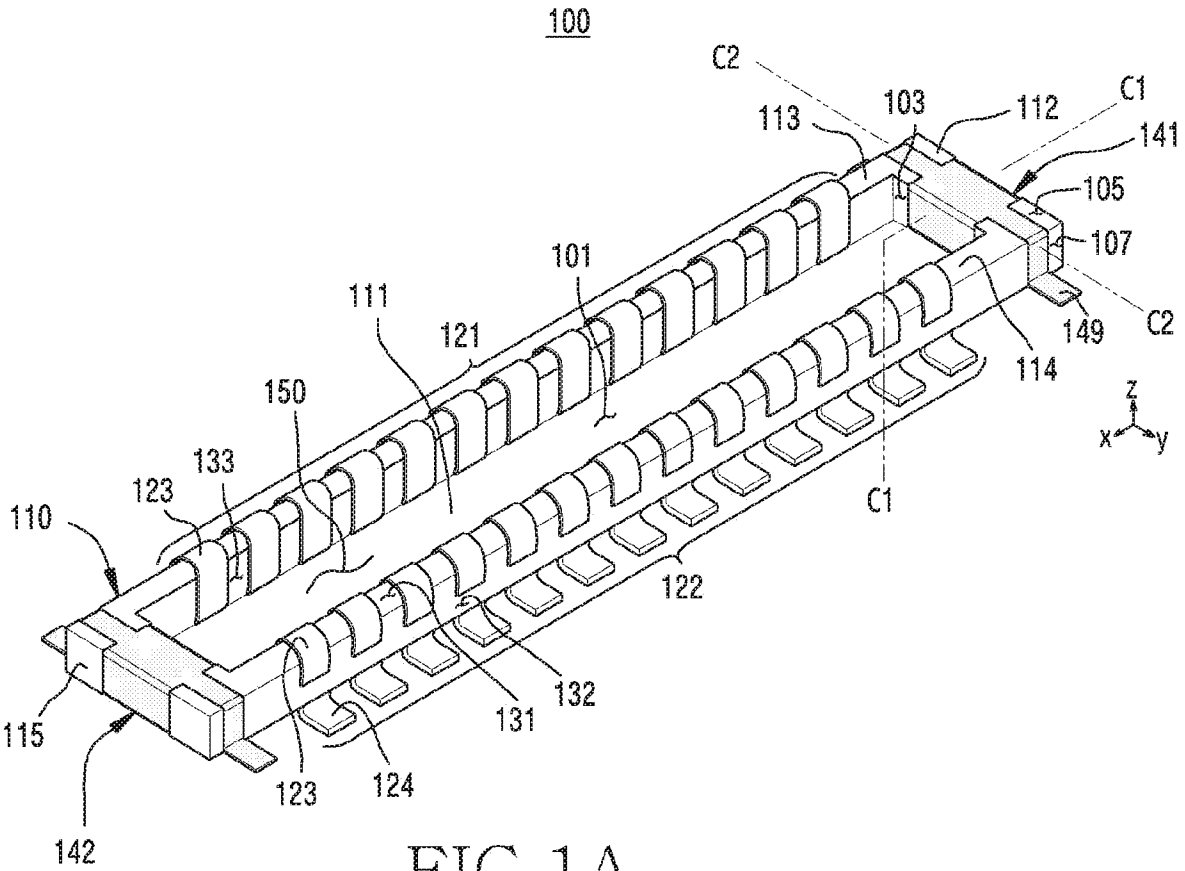
FIG. 1A is a perspective view of a front surface of a header connector according to an embodiment.

Hereinafter, various embodiments of the disclosure will be described with reference to the accompanying drawings. It should be appreciated that various embodiments of the disclosure and the terms used therein are not intended to limit the technological features set forth herein to particular embodiments and include various changes, equivalents, or alternatives for a corresponding embodiment. With regard to the description of the drawings, similar reference numerals may be used to designate similar or relevant elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include all possible combinations of the items enumerated together in a corresponding one of the phrases. As used herein, such terms as "a first", "a second", "the first", and "the second" may be used to simply distinguish a corresponding element from another, and does not limit the elements in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

Figure 1B:
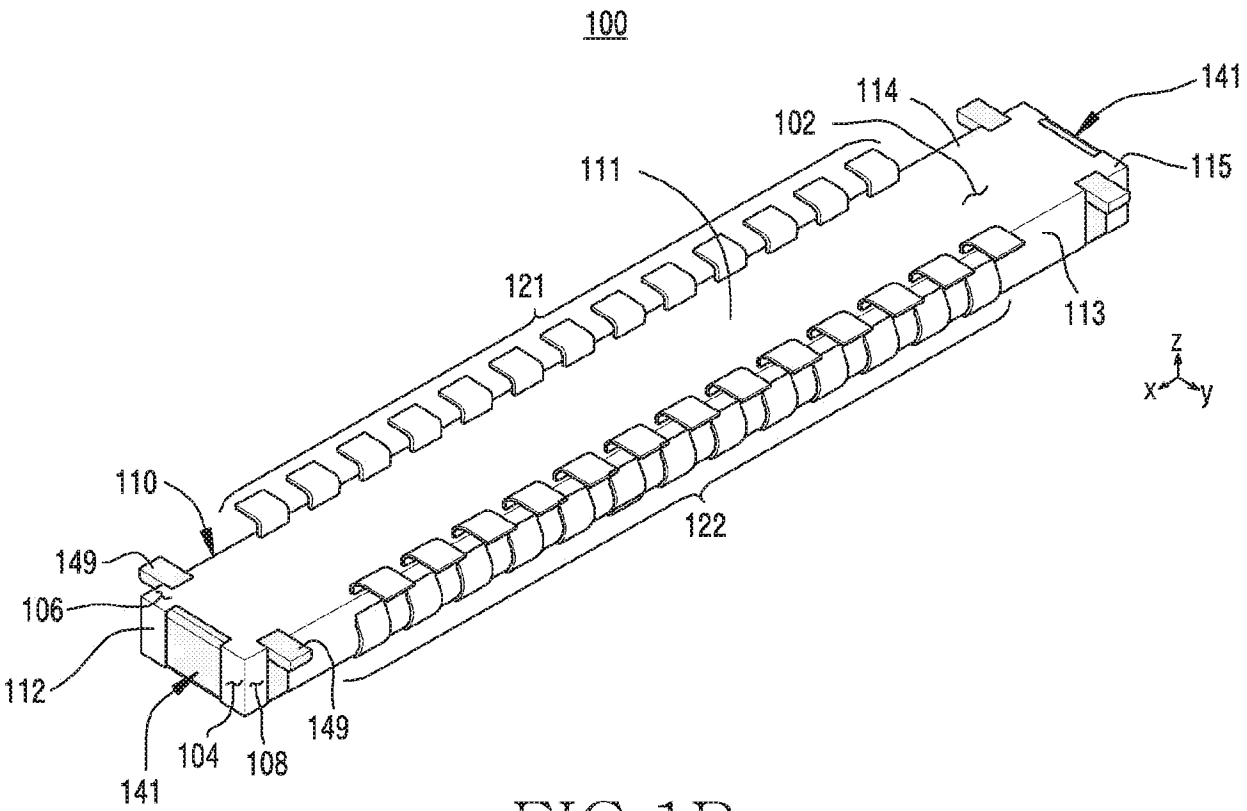
FIG. 1B is a perspective view of a rear surface of the header connector of FIG. 1A.
Figure 1C:
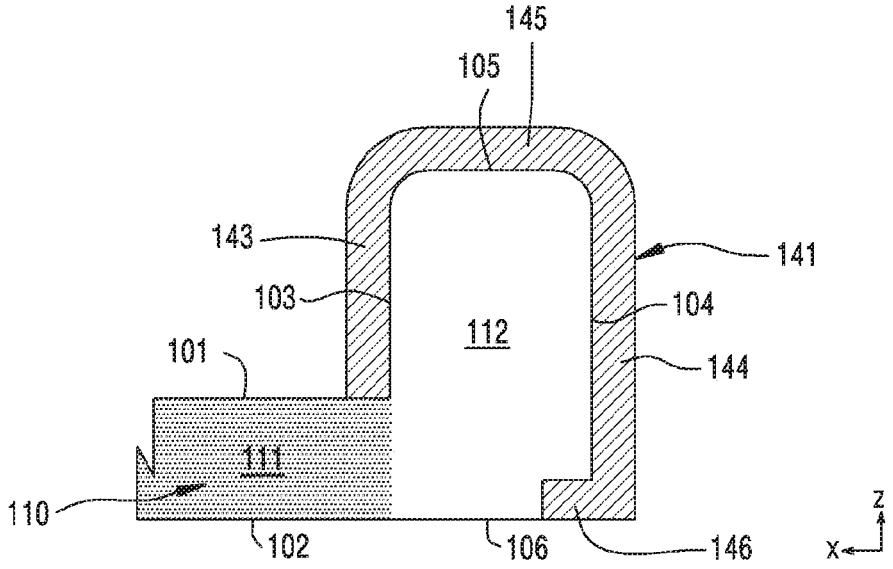
FIG. 1C is a cross-sectional view corresponding to C1-C1 in the perspective view of FIG. 1A.
Figure 1D:
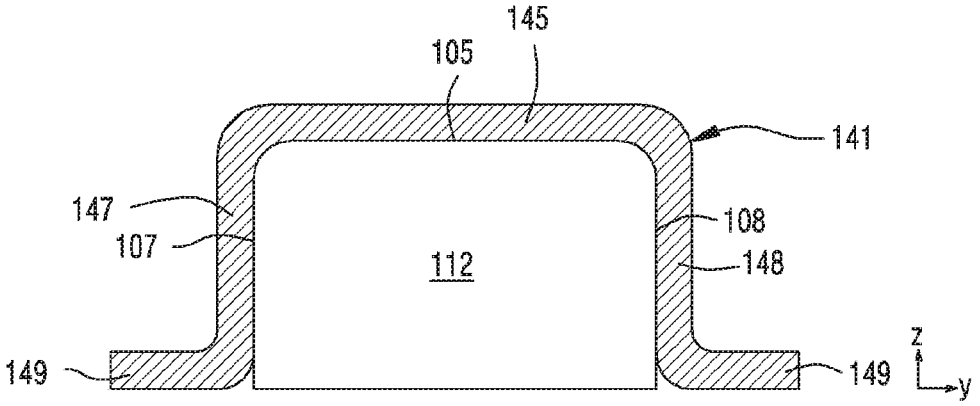
FIG. 1D is a cross-sectional view corresponding to C2-C2 in the perspective view of FIG. 1A.

FIG. 1A is a perspective view of a front surface of a header connector according to an embodiment. FIG. 1B is a perspective view of a rear surface of the header connector of FIG. 1A. FIG. 1C is a cross-sectional view corresponding to C1-C1 in the perspective view of FIG. 1A. FIG. 1D is a cross-sectional view corresponding to C2-C2 in the perspective view of FIG. 1A.

Referring to FIGS. 1A and 1B, a header connector 100 may include a first structure 110, a plurality of conductive terminals 121 and 122 disposed in the first structure 110, and metal members 141 and 142.

The first structure 110, for example, may be formed of a nonmetal material such as plastic or polymer, and the plurality of conductive terminals 121 and 122 may be coupled to the first structure 110 to remain physically separated from each other. According to an embodiment, the first structure 110 may include a first plate 111 including a first surface 101 and a second surface 102 facing a side that is opposite to a side which the first surface 101 faces. The first structure 110 may include a first side wall 112 that is perpendicular to the first plate 111 and a second side wall 113 that is perpendicular to the first side wall 112 and the first plate 111. The first structure 110 may include a third side wall 114 that is perpendicular to the first side wall 112 and the first plate 111 and is parallel to the second side wall 113. The first structure 110 may include a fourth side wall 115 that is perpendicular to the first plate 111 and is parallel to the first side wall 112. The first surface 101 of the first plate 11, the first side wall 112, the second side wall 113, the third side wall 114, and the fourth side wall 115 may define a recess 150. The recess 150 may be a space that is concave in the −z axis direction.

According to an embodiment, the plurality of conductive terminals 121 and 122 may include first terminals 121 disposed in a row in the second side wall 113 and second terminals 122 disposed in a row in the third side wall 114. The second side wall 113 and the third side wall 114 may have a length that allows the plurality of conductive terminals 121 and 122 to be arranged, and may be larger than the first side wall 112 and the fourth side wall 114. According to an embodiment, the numbers of the first terminals 121 and the second terminals 122 may be the same and the first terminals 121 and the second terminals 122 may be disposed symmetrically. According to some embodiments, the numbers of the first terminals 121 and the second terminals 122 may be different. The first terminals 121 or the second terminals 122 may be disposed at a predetermined interval, or according to some embodiments, the interval of some terminals may be designed to be different from the interval of the other terminals. The plurality of conductive terminals 121 and 122 may be classified into a ground terminal, a data transmission terminal, a data receiving terminal, a device recognition terminal, or the like to be utilized.

The plurality of conductive terminals 121 and 122 may have substantially the same form, and according to an embodiment, may include a contact 123 surrounding the upper surfaces 131 and the opposite side surfaces 132 and 133 of the side walls 113 and 114, and a tail 124 extending from the contact 123 and protruding to opposite sides of a lower portion of the first structure 110. If the header connector 110 and the socket connector (not illustrated) are coupled to each other, the contact 123 may be electrically connected to the conductive terminals of the socket connector. The tail 124 may be coupled to a land disposed in a printed circuit board (PCB) (not illustrated) by using soldering. According to an embodiment, the printed circuit board may include a rigid printed circuit board or a flexible printed circuit board (FPCB). According to an embodiment, a portion of each of the plurality of conductive terminals 121 and 122 may be disposed in the interior of the first structure 110, and accordingly, the plurality of conductive terminals 121 and 122 may be fixed to the first structure 110. For example, portions of the plurality of conductive terminals 121 and 122 may be fixed to the interior of the first structure 110 through a process of injection-molding the first structure 110 coupled to the plurality of conductive terminals 121 and 122. According to various embodiments, an organic joining layer such as a polymer may be disposed between the contact 123 and the first structure 110.

The metal members 141 and 142 may cover at least one surface of the first structure 110 to prevent the first structure 110 from being damaged by an impact or a load when the header connector 100 and the socket connector (not illustrated) are coupled to each other. According to an embodiment, the metal members 141 and 142 may include a first metal member 141 coupled to the first side wall 112 and a second metal member 142 coupled to the fourth side wall 115.

Referring to FIGS. 1A, 1B, 1C, and 1D, the first side wall 112 may include a third surface 103 defining the recess 150 and a fourth surface 104 facing a side that is opposite to a side which the third surface 103 faces. In FIGS. 1C and 1B, the first plate 111 is simply indicated by a dotted area to distinguish the first plate 111 from the side walls 112, 113, 114, and 115, and it is apparent that the first plate 111 is integrally formed with the side walls 112, 113, 114, and 115 by using the same material. The first side wall 112 may include a sixth surface 106 defining a rear surface of the first structure 110 together with the second surface 102, and a fifth surface 105 facing a side that is opposite to a side which the sixth surface 106 faces. The first side wall 112 may include a seventh surface 107 and an eighth surface 108 defining a side surface of the first structure 110 together with the fourth surface 104 and disposed on opposite sides. According to an embodiment, the first metal member 141 may be an integral metal plate including areas 143, 144, 145, 146, 147, and 148 that cover the third surface 103, the fourth surface 104, the fifth surface 105, the sixth surface 106, the seventh surface 107, and the eighth surface 108. The first metal member 141 may be formed by cutting and bending a metal plate or may be formed through die casting. According to some embodiments, although not illustrated, the first metal member 141 may be designed to have an area that covers a portion of the first surface 101. According to an embodiment, the first metal member 141 may include an area extending from an area 148 that covers the eighth surface 108 and protruding area 149 to opposite sides of a lower portion of the first structure 110. This area 149 may be coupled to a land disposed in the printed circuit board (not illustrated) by using soldering, and may be disposed at various different areas. The first metal member 141 is not limited to the illustrated forms, and may be formed in various forms by deforming (e.g., expanding, contracting, or excluding) some of the areas 143, 144, 145, 146, 147, 148, and 149 or adding other areas.

According to various embodiments, the first metal member 141 may be configured to have an area that covers a portion of the second side wall 113 or the third side wall 114.

According to various embodiments, the first metal member 141 may have a plurality of areas that are physically separated from each other.

According to an embodiment, at least a partial area of the first metal member 141 may be disposed to be inserted into a recess (or a concave space) (not illustrated) disposed in the first side wall 112.

According to various embodiments, an organic joining layer such as a polymer may be disposed between the first metal member 141 and the first structure 110. The organic joining layer may prevent at least a portion of the first metal member 141 from coming over or being separated from the first structure 110. In an embodiment, referring to FIG. 1C, a partial area 146 of the first metal member 141 that covers the seventh surface 107 of the first structure 110 functions like a hook for snap-fitting when the first metal member 141 is located in the first side wall 112 and thus may increase a coupling force between the first side wall 112 and the first metal member 141. It is apparent that various other structures for increasing a coupling force between the first metal member 141 and the first structure 110 may be utilized.

The second metal member 142 is disposed in the fourth side wall 115 to be symmetrical to the first metal member 141, and a detailed description thereof will be omitted.

The metal member 141 and 142 may reduce the influences of an impact or a load due to the socket connector, which is applied to the first structure, when the header connector 100 and the socket connector (not illustrated) are coupled to each other. According to some embodiments, a coating layer (not illustrated) that replaces the metal member 141 or 142 may be utilized. According to some embodiments, a nonmetal member that replaces the metal member 141 or 142 may be utilized. In addition, it is apparent that various resistance structures or strength structures that replace the metallic member 141 or 142 may be utilized.

Figure 2A:
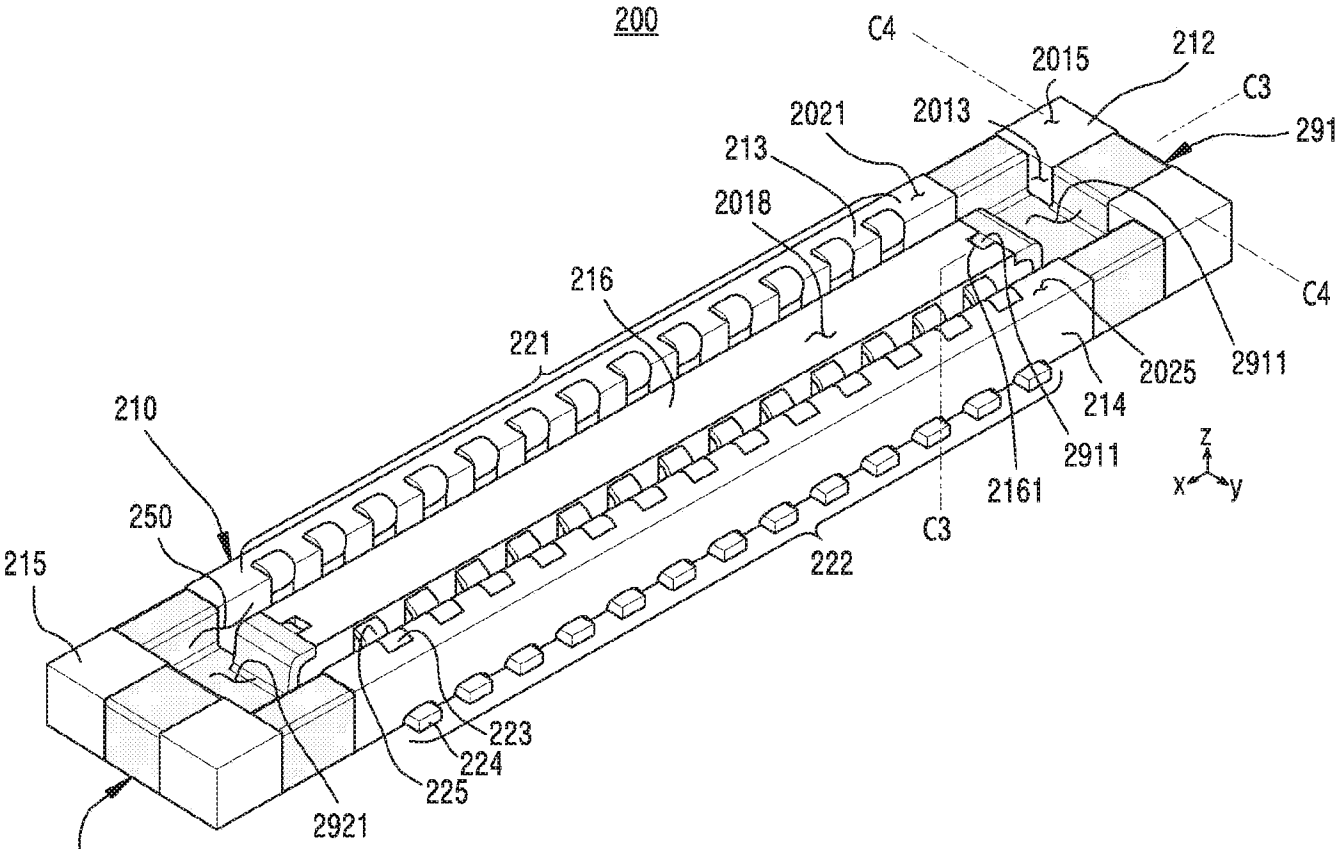
FIG. 2A is a perspective view of a front surface of a socket connector according to an embodiment.
Figure 2B:
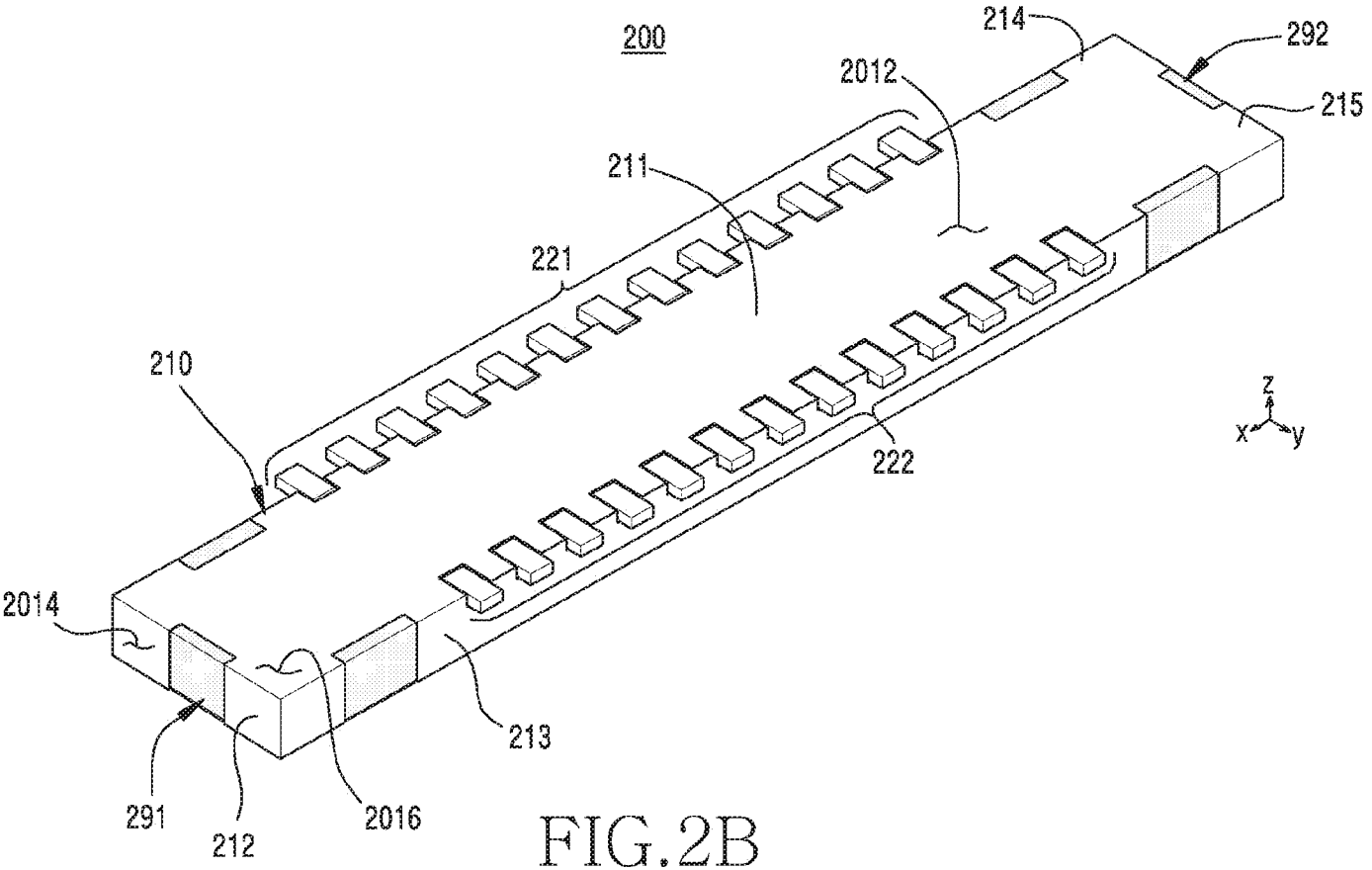
FIG. 2B is a perspective view of a rear surface of the socket connector of FIG. 2A.
Figure 2C:
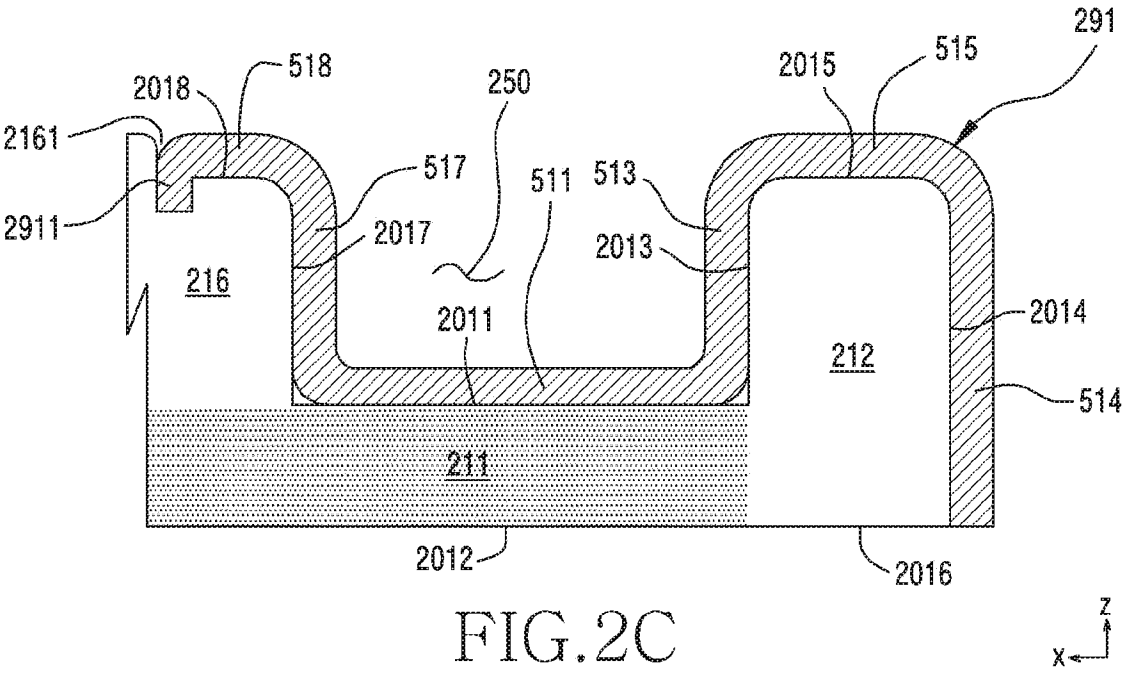
FIG. 2C is a cross-sectional view corresponding to C3-C3 in the perspective view of FIG. 2A.
Figure 2D:
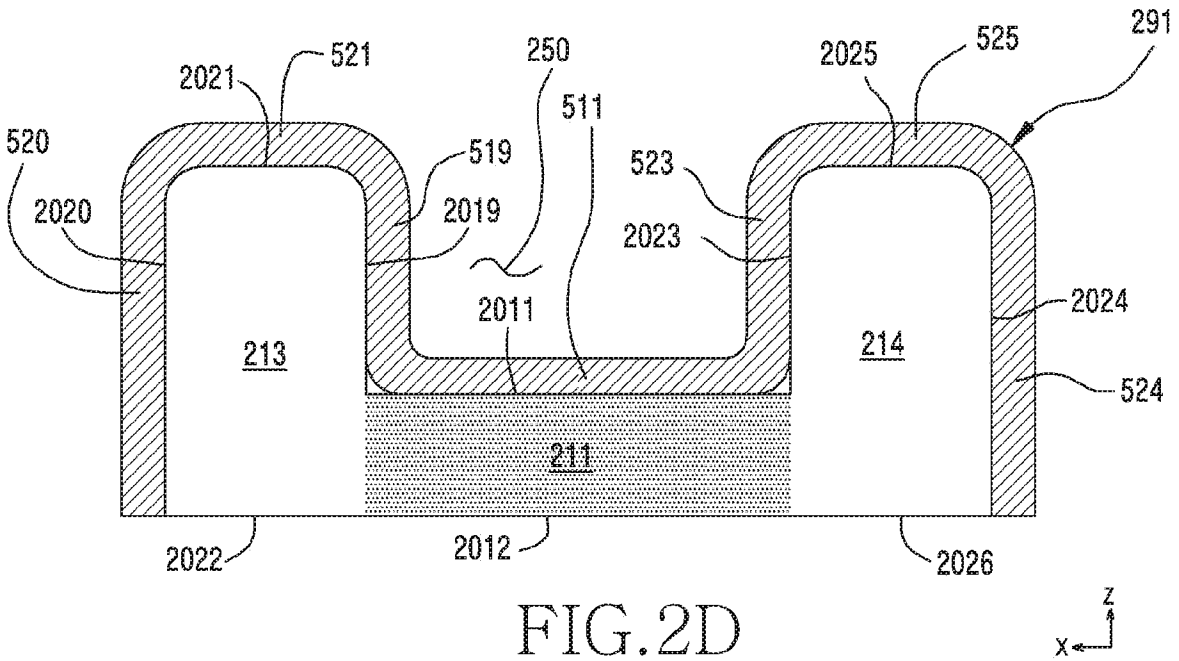
FIG. 2D is a cross-sectional view corresponding to C4-C4 in the perspective view of FIG. 2A.

FIG. 2A is a perspective view of a front surface of a socket connector according to an embodiment. FIG. 2B is a perspective view of a rear surface of the socket connector of FIG. 2A. FIG. 2C is a cross-sectional view corresponding to C3-C3 in the perspective view of FIG. 2A. FIG. 2D is a cross-sectional view corresponding to C4-C4 in the perspective view of FIG. 2A.

Referring to FIGS. 2A and 2B, a socket connector 200 may include a second structure 210, a plurality of conductive terminals 221 and 222 disposed in the second structure 210, and metal members 291 and 292. The socket connector 200 is a connector that may be coupled to the header connector 100 of FIGS. 1A and 1B, and FIGS. 1A, 1B, 1C, and 1D will be referenced again in the following description.

The second structure 210 may be formed of a nonmetal material such as plastic or polymer, and the plurality of conductive terminals 221 and 222 may be coupled to the second structure 210 to remain physically separated from each other. According to an embodiment, the second structure 210 may include a second plate including an eleventh surface (not illustrated) and a twelfth surface 2012 facing a side that is opposite to a side which the eleventh surface faces. The second structure 210 may include an eleventh side wall 212 that is perpendicular to the second plate 211 and a second side wall 213 that is perpendicular to the eleventh side wall 212 and the second plate 211. The second structure 210 may include a thirteenth side wall 214 that is perpendicular to the eleventh side wall 212 and the second plate 211 and is parallel to the twelfth side wall 213. The second structure 210 may include a fourteenth side wall 215 that is perpendicular to the second plate 211 and is parallel to the eleventh side wall 212. The second structure 210 may include a protrusion 216 extending from the second plate 211 and surrounded by the side walls 212, 213, 214, and 215. The protrusion 216 may be disposed to be spaced apart from the side walls 212, 213, 214, and 215 with a spacing space interposed therebetween. According to an embodiment, the protrusion 216 may include an upper surface (e.g., the eighteenth surface 2018) spaced apart from the second plate 211, and side surfaces (not illustrated) connecting the upper surface 2018 and the second plate 211. The second plate 211, the protrusion 216, the eleventh side wall 212, the twelfth side wall 213, the thirteenth side wall 214, and the fourteenth side wall 215 may define the recess 250 together, and the recess 250 may be a rectangular annular space that is concave in the −z axis direction.

If the socket connector 200 and the header connector 100 are coupled to each other, the side walls 112, 113, 114, and 115 of the header connector 100 may be inserted into the recess 250 of the socket connector 200, and the protrusion 216 of the socket connector 200 may be inserted into the recess 250 of the header connector 100. The socket connector 200 may be coupled to the plurality of conductive terminals 121 and 122, and according to an embodiment, may include a fixing part 223 coupled to the side wails 213 and 214, a free end 225 extending from the fixing part 223, and a tail 224 extending from the fixing part 223 and protruding to opposite sides of a lower portion of the second structure 210. The free end 225 may be supported by the fixing part 223 and has flexibility, and may elastically press the terminal of the header connector 100 when the socket connector 200 and the header connector 100 are coupled to each other. The protrusion 216 may include a space (not illustrated) for allowing the free end 225 to move when the free end 225 is bent in correspondence to the terminal of the header connector 100. The tail 224 may be coupled to a land disposed in the printed circuit board (not illustrated) by using soldering. According to various embodiments, the printed circuit board may include a rigid printed circuit board or a flexible printed circuit board. According to an embodiment, the tail 224 of the socket connector 200 may be coupled to a printed circuit board that is different from the printed circuit board, to which the header connector 100 is coupled, and the two printed circuit boards may be electrically connected to each other through connection of the two connectors 100 and 200.

The metal members 291 and 292 may cover at least one surface of the second structure 210 to prevent the second. structure 210 from being damaged by an impact or a load when the socket connector 200 and the header connector 100 are coupled to each other. According to an embodiment, the metal members 291 and 292 may include a third metal member 291 and a fourth metal member 292 disposed on opposite sides of the second structure 210 to be symmetrical to each other. Referring to FIGS. 2A, 2B, 2C, and 2D, the eleventh side wall 212 may include a thirteenth surface 2013 defining the recess 250 and a fourteenth surface 2014 facing a side that is opposite to a side which the thirteenth surface 2013 faces. In FIGS. 2C and 2D, the second plate 211 is simply indicated by a dotted area to distinguish the second plate 211 from the side walls 212, 213, 214, and 215, or the protrusion 216 and it is apparent that the second plate 211 is integrally formed with the side walls 212, 213, 215, and 115 or the protrusion 216 by using the same material. The eleventh side wall 212 may include a sixteenth surface 2016 defining a rear surface of the second structure 210 together with the twelfth surface 2012, and a fifteenth surface 2015 facing a side that is opposite to a side which the sixteenth surface 2016 faces. The protrusion 216 may include a seventh surface 2017 facing the third surface 2013 and an eighteenth surface 2018 facing a side that is opposite to a side which the second surface 2012 faces. The twelfth side wall 213 may include a ninth surface 2019 defining the recess 250 and a twelfth surface 2020 facing a side that is opposite to a side which the ninth surface 2019 faces. The twelfth side wall 213 may include a twenty second surface 2022 defining a rear surface of the second structure 210 together with the twelfth surface 2012, and a twenty first surface 2021 facing a side that is opposite to a side which the twenty second surface 2022 faces. The thirteenth side wall 214 may include a twenty third surface 2023 defining the recess 250 and a twenty fourth surface 2024 facing a side that is opposite to a side which the twenty third surface 2023 faces. The thirteenth side wall 214 may include a twenty sixth surface 2026 defining a rear surface of the second structure 210 together with the twelfth surface 2012, and a twenty fifth surface 2025 facing a side that is opposite to a side which the twenty sixth surface 2026 faces. According to an embodiment, the third metal member 291 may be an integral metal plate including areas 511, 513, 514, 515, 517, 518, 519, 520, 521, 523, 524, and 525 that cover the eleventh surface 2011, the thirteenth surface 2013, the fourteenth surface 2014, the fifteenth surface 2015, the seventh surface 2017, the eighteenth surface 2018, the ninth surface 2019, the twentieth surface 2020, the twenty first surface 2021, the twenty third surface 2023, the twenty fourth surface 2024, and the twenty fifth surface 2025. According to various embodiments, the eleventh side wall 212 may further include opposite surfaces (not illustrated) defining a side surface of the second structure 210 together with the fourteenth surface 2014 and disposed on opposite sides, and although not illustrated, the third metal member 291 may be designed to further cover the opposite surfaces. The third metal member 291 may be formed by cutting and bending a metal plate or may be formed through die casting.

The third metal member 291 is not limited to the illustrated forms, and may be formed in various forms by deforming (e.g., expanding, contracting, or excluding) some of the areas 511, 513, 514, 515, 517, 518, 519, 520, 521, 523, 524, and 525 or adding other areas.

According to various embodiments, the third metal member 291 may have a plurality of areas that are physically separated from each other.

According to an embodiment, at least a partial area of the third metal member 291 may be disposed to be inserted into a recess (or a concave space) (not illustrated) disposed in the second structure 210.

According to various embodiments, an organic joining layer such as a polymer may be disposed between the third metal member 291 and the second structure 210. The organic joining layer may prevent at least a portion of the third metal member 291 from coming over or being separated from the second structure 210.

In an embodiment, referring to FIGS. 2A and 2C, the protrusion 216 may include a recess 2161 formed by removing a portion of the eighteenth surface 2018, and a portion 2911 of the third metal member 291 may be formed like a hook to be coupled to the recess 2161 through snap-fitting. The snap-fitting structure may be applied to various other locations. It is apparent that various other structures for increasing a coupling force between the third metal member 291 and the second structure 210 may be utilized.

According to some embodiments, a coating layer (not illustrated) that replaces the metal member 291 or 292 may be utilized. According to some embodiments, a nonmetal member that replaces the metal member 291 or 292 may be utilized. In addition, it is apparent that various resistance structures or strength structures that replace the metallic member 291 or 292 may be utilized.

The fourth metal member 292 is disposed in the second structure 210 to be symmetrical to the third metal member 291, and a detailed description thereof will be omitted.

Referring to FIGS. 1A and 2A, when the two connectors 100 and 200 are coupled to each other, the first side wall 112, in which the first metal member 141 is disposed, may be inserted into a space 2911, in which the third metal member 291 is o disposed, and the fourth side wall 115, in which the second metal member 142 is disposed, may be inserted into a space 2921, in which the fourth metal member 292 is disposed. Because an impact or a load applied to the first structure 110 and the second structure 210 may be reduced by the metal members 141, 142, 291, and 292 when the two connectors 100 and 200 are coupled to each other, damage to the first structure 110 and the second structure 210 may be prevented.

Referring to FIG. 2C again, a connection part or a bending part between the areas 517 and 518 of the third metal member 291 that covers the seventh surface 2017 and the eighteenth surface 2018, and a connection part or a bending part between the areas 513 and 515 of the third metal member 291 that covers the thirteenth surface 2013 and the fifteenth surface 2015 may have smooth curve forms, and this may make the fitting of the socket connector 200 and the header connector 100 smooth. Referring to FIG. 2D again, a connection part or a bending part between the areas 519 and 521 of the third metal member 291 that covers the nineteenth surface 2019 and the twenty first surface 2021, and the areas 523 and 525 of the third metal member 291 that covers the twenty third surface 2023 and the twenty fifth surface 2025 may have curve forms, and this may also make the fitting of the socket connector 200 and the header connector 100 smooth. Similarly, referring to FIG. 1C again, a connection part or a bending part between the areas 143 and 145 of the first metal member 141 that covers the third surface 103 and the fifth surface 105, and a connection part or a bending part between the areas 144 and 145 of the first metal member 141 that covers the fourth surface 104 and the fifth surface 105 may have smooth curve forms, and this makes the fitting of the socket connector 200 and the header connector 100 smooth.

Referring to FIGS. 1A and 2A, if the header connector 100 and the socket connector 200 are coupled to each other, the first metal member 141 of the header connector 100 may be electrically connected to the third metal member 291 of the socket connector 200, and the second metal member 142 of the header connector 100 may be electrically connected to the fourth metal member 292 of the socket connector 200. According to an embodiment, the metal members 141 and 142 of the header connector 100 and the metal members 291 and 292 of the socket connector 200 may be utilized as electrical paths to the ground in an electronic device, on which the header connector 100 and the socket connector 200 are mounted. According to some embodiments, the metal members 141 and 142 of the header connector 100 and the metal members 291 and 292 of the socket connector 200 may be utilized as electrical paths for transmitting electric power in an electronic device, on which the header connector 100 and the socket connector 200 are mounted. For example, an area 149 of the header connector 100 may be electrically connected to a power management circuit (e.g., a power management integrated circuit (PMIC)). According to various embodiments, the metal members 141 and 142 of the header connector 100 and the metal members 291 and 292 of the socket connector 200 may be utilized as electrical paths for transmitting and receiving data or recognizing a device.

According to an embodiment, the metal members 141 and 142 of the header connector 100 and the metal members 291 and 292 of the socket connector 200 may be utilized in a circuit for detecting a connection state of the header connector 100 and the socket connector 200. For example, an area 149 of the metal members 141 and 142 of the header connector 100 may be electrically connected to a processor of an electronic device by the medium of a circuit utilizing a pull-up resistor or a pull-down resistor mounted on the printed circuit board. If the socket connector 200 is connected to the header connector 100, the metal members 141 and 142 of the header connector 100 and the metal members 291 and 292 of the socket connector 200 may be electrically connected to each other, and the processor may determine whether the header connector 100 and the socket connector 200 are connected to each other by using the pull-up resistor.

Figure 3A:
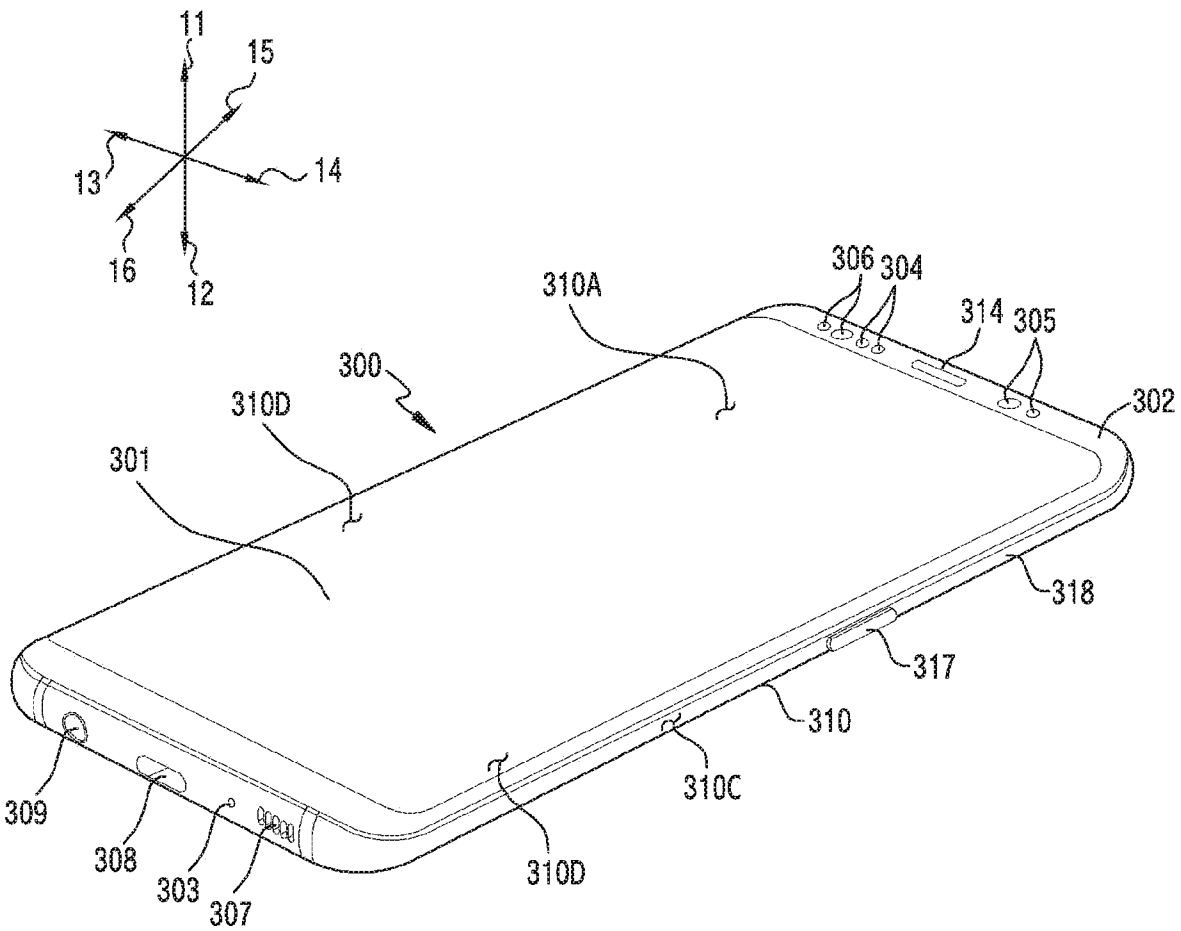
FIG. 3A is a perspective view of a front surface of a mobile electronic device including a header connector and a socket connector according to an embodiment.
Figure 3B:
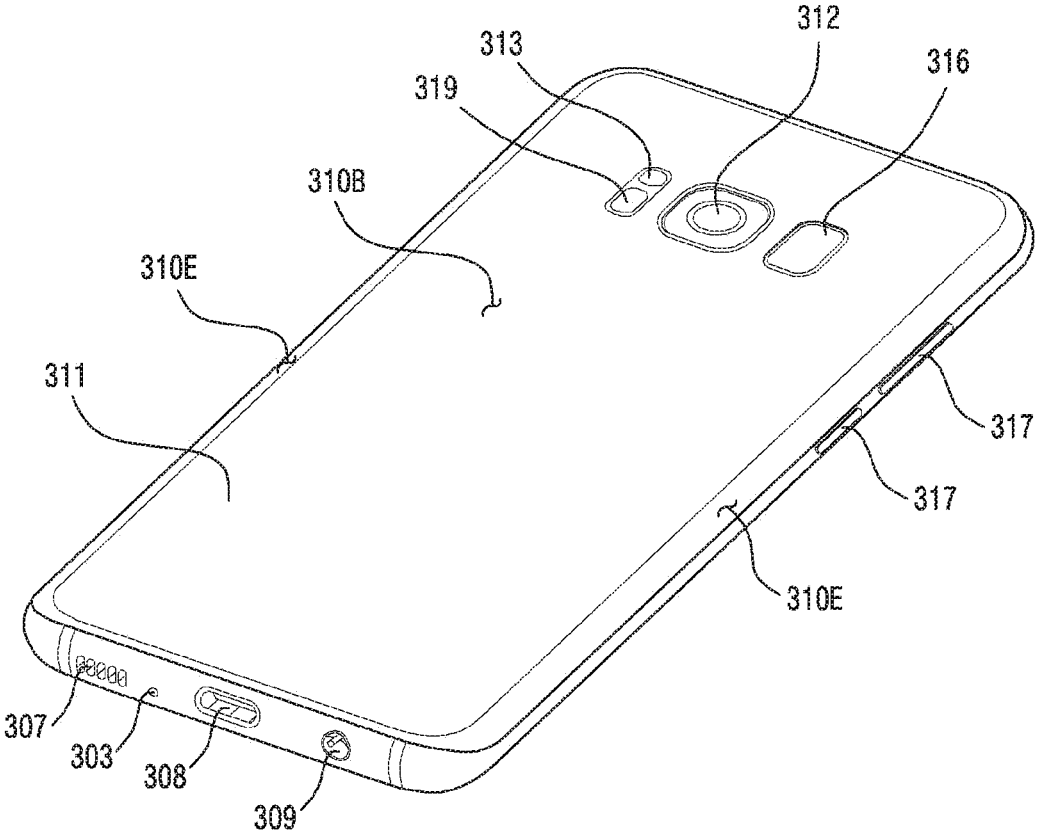
FIG. 3B is a perspective view of a rear surface of the electronic device of FIG. 3A.
Figure 4:
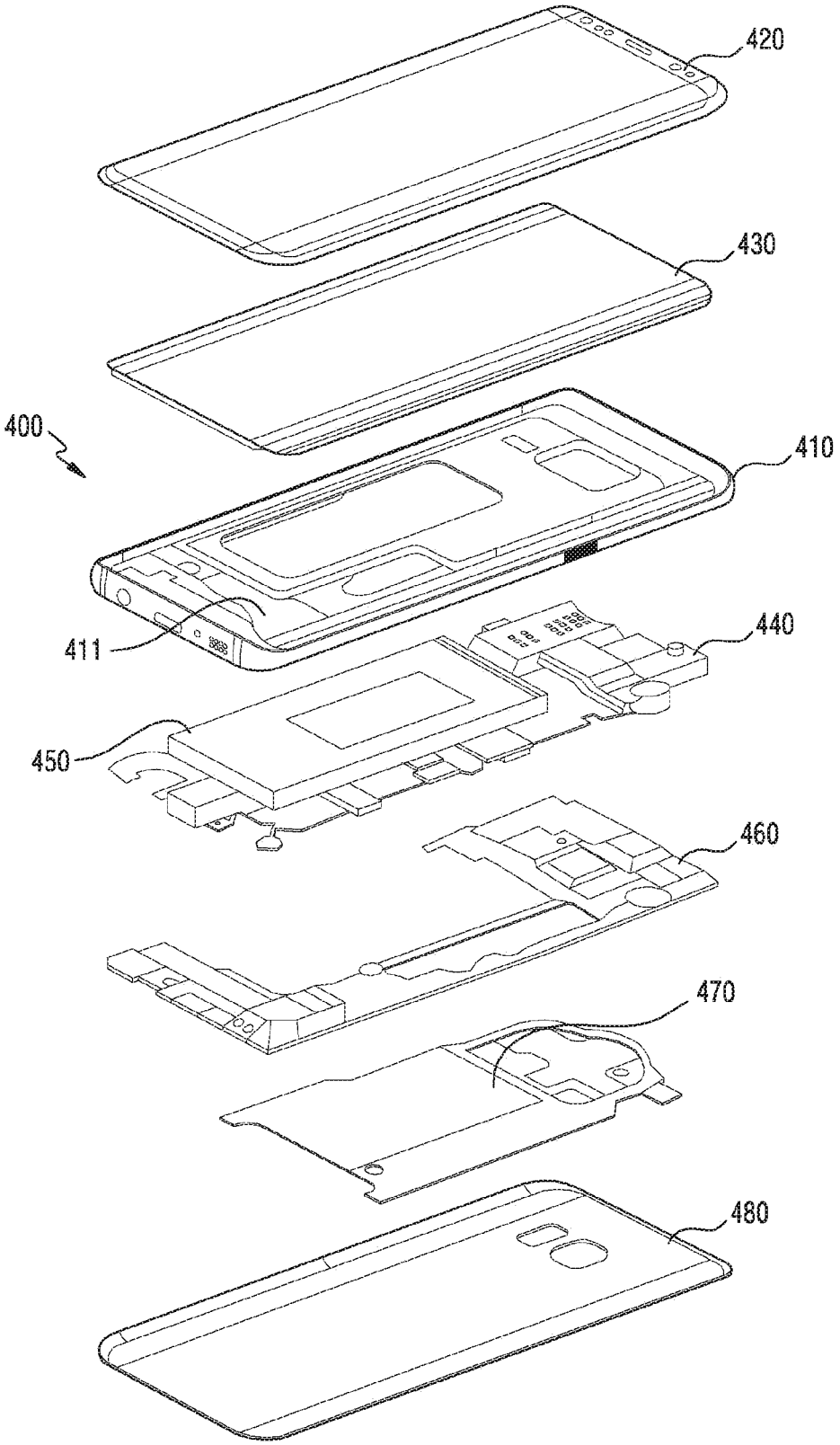
FIG. 4 is a deployed perspective view of the electronic device of FIG. 3A.

FIG. 3A is a perspective view of a front surface of a mobile electronic device including a header connector and a socket connector according to an embodiment. FIG. 3B is a perspective view of a rear surface of the electronic device of FIG. 3A. FIG. 4 is a deployed perspective view of the electronic device of FIG. 3A.

Referring to FIGS. 3A and 3B, an electronic device 300 according to an embodiment may include a housing 310 including a front surface 301, a rear surface 310B, and a side surface 310C surrounding space between the front surface 301 and the rear surface 310B. In another embodiment (not illustrated), the housing may refer to a structure that defines some of the front surface 301, the rear surface 310B, and the side surface 310C of FIG. 3A. According to an embodiment, the front surface 301 may be defined by a front plate 302 (e.g., a glass plate or a polymer plate including various coating layers), at least a portion of which is substantially transparent. The rear surface 310B may be formed by a rear plate 311 that is substantially opaque. The rear plate 311, for example, may be formed of coated or colored glass, ceramics, a polymer, a metal (e.g., aluminum, stainless steel (STS), or magnesium), or a combination of at least two thereof. The side surface 1100 is coupled to the front plate 302 and the rear plate 311, and may be formed by a side bezel structure (or 'a side member') 318 including a metal and/or a polymer. In some embodiments, the rear plate 311 and the side bezel structure 318 may be integrally formed and may include the same material (e.g., a metallic material such as aluminum).

In the illustrated embodiment, the front plate 302 may include two first areas 310D that are deflected from the front surface 301 toward the rear plate 311 and extend seamlessly, at opposite ends of a long edge of the front plate 302. In the illustrated embodiment (see FIG. 1B), the rear plate 311 may include two second areas 310E that are deflected from the second surface 310B toward the front plate 302 and extend seamlessly, at opposite ends of a long edge of the rear plate 311. In some embodiments, the front plate 302 (or the rear plate 311) may include only one of the first areas 3108 (or the second areas 310E). In other embodiments, some of the first areas 310D or the second areas 310E may not be included. In the embodiments, when viewed from a side of the electronic device 300, the side bezel structure 318 may have a first thickness (or width) on a side surface on which neither the first areas 310D nor the second areas 310E are included, and may have a second thickness that is smaller than the first thickness on a side surface on which the first areas 310D or the second areas 310E are included.

According to an embodiment, the electronic device 300 may include at least one of a display 301, audio modules 303, 307, 314, sensor modules 304, 316, and 319, camera modules 305, 312, and 313, a key input device 317, a light emitting element 306, and connector holes 308 and 309. In some embodiments, at least one (e.g., the key input device 317 or the light emitting element 306) of the elements may be omitted from the electronic device 300 or another component may be additionally included in the electronic device 300.

The display 301, for example, may be exposed through a corresponding portion of the front plate 302. In some embodiments, at least a portion of the display 301 may be exposed through the front plate 302 that defines the front surface 301, and the first areas 310D of the side surface 310C. In some embodiments, corners of the display 301 may have a shape that is substantially the same as the adjacent outer shape of the front plate 302. In other embodiments (not illustrated), in order to expand the area, by which the display 301 is exposed, the intervals between the outskirts of the display 301 and the outskirts of the front plate 302 may be substantially the same.

In other embodiments (not illustrated), a portion of the screen display area of the display 301 may have a recess or an opening, and may include at least one of the audio module 314, the sensor module 304, the camera module 305, and the light emitting element 306, which are aligned with the recess or the opening. In other embodiments (not illustrated), at least one of the audio module 314, the sensor module 304, the camera module 305, the fingerprint sensor 316, and the light emitting element 306 may be included on the rear surface of the screen display area of the display 301. In other embodiments (not illustrated), the display 301 may be coupled to or be disposed to be adjacent to a touch detection circuit, a pressure sensor that may measure the strength (the pressure) of a touch, and/or a digitizer that detects a stylus pen of a magnetic field type. In some embodiments, at least a portion of the sensor modules 304 and 319 and/or at least a portion of the key input device 317 may be disposed in the first areas 310D and/or the second areas 310E.

The audio modules 303, 307, 314 may include a microphone hole 303 and speaker holes 307 and 314. A microphone for acquiring external sounds may be disposed in the microphone hole 303, and in some embodiments, a plurality of microphones may be disposed to detect the direction of a sound. The speaker holes 307 and 314 may include an external speaker hole 307 and a communication receiver hole 314. In some embodiments, the speaker hole 307 and 314 and the microphone hole 303 may be realized by one hole or a speaker may be included while a speaker hole 307 and 314 is not employed (e.g., a piezoelectric speaker).

The sensor modules 304, 316, and 319 may generate an electrical signal or a data value corresponding to an operational state of the interior of the electronic device 300 or anenvironmental state of the outside. The sensor modules 304, 316, and 319, for example, may include a first sensor module 304 (e.g., a proximity sensor) and a second sensor module (not illustrated) (e.g., a fingerprint sensor) disposed on the front surface 301 of the housing 310, and/or a third sensor module 319 (e.g., a HRM sensor) and/or a fourth sensor module 316 (e.g., a fingerprint sensor) disposed on the rear surface 310B of the housing 310. The fingerprint sensor may be disposed not only on the front surface 310A (e.g., the display 301) but also the rear surface 310B of the housing 310. The electronic device 300 may further include a sensor module (not illustrated), for example, at least one of a gesture sensor, a gyro sensor, an atmospheric pressure sensor a magnetic sensor, an acceleration sensor, a grip sensor, a color sensor, an infrared (IR) sensor, a biometric sensor, a temperature sensor, a humidity sensor, or an illumination sensor 304.

The camera modules 305, 312, and 313 may include a first camera device 305 disposed on the front surface 301 of the electronic device 300, and a second camera device 312 and/or a flash 313 disposed on the rear surface 310B. The camera modules 305 and 312 may include one or a plurality of lenses, an image sensor, and/or an image signal processor. The flash 313, for example, may include a light emitting diode or a xenon lamp. In some embodiments, two or more lenses (an infrared ray camera, and a wide angle/telephoto lens), and image sensors may be disposed on one surface of the electronic device 300.

The key input device 317 may be disposed on the side surface 310C of the housing 310. In another embodiment, the electronic device 300 may not include some or all of the above-mentioned key input devices 317 and the key input devices 317 which are not included, may be realized in different forms, such as a soft key, on the display 301. In some embodiments, the key input device may include a sensor module 316 disposed on the rear surface 310B of the housing 310.

The light emitting device 306, for example, may be disposed. on the front surface 301 of the housing 310. The light emitting element 306, for example, may provide state information on the electronic device 300 in the form of light. In other embodiments, the light emitting element 306, for example, may provide a light source that interworks with an operation of the camera module 305. The light emitting element 306, for example, may include an LED, an IR LED, and a xenon lamp.

The connector holes 308 and 309 may include a first connector hole 308 that may accommodate a connector (e.g., a USE connector) for transmitting and receiving electric power and/or data to and from an external electronic device and/or a second connector hole (e.g., an earphone jack) 309 that may accommodate a connector for transmitting and receiving an audio signal to and from the external electronic device.

According to an embodiment, the electronic device 300 may include a header connector (e.g., the header connector 100 of FIG. 1A) and a socket connector (the header connector 200 of FIG. 2A). The header connector and the socket connector are electrically connected to, among the above-described elements (e.g., a display 303, a microphone, a speaker, a receiver, sensor modules 304, 316 and 319, camera modules 305, 312, and 313, a key input device 317, or a light emitting element 306), a first element and a second element, respectively, and the first element and the second element may be electrically connected to each other through connection of the header connector and the socket connector.

Referring to FIG. 4, an electronic device 400 may include a side bezel structure 410, a first support member 411 (e.g., a bracket), a front plate 420, a display 430, a printed circuit board 440, a battery 450, a second support member 460 (e.g., a rear case), an antenna 470, and a rear plate 480. In some embodiments, at least one (e.g., the first support member 411 or the second support member 460) of the elements may be omitted from the electronic device 400 or another component may be additionally included in the electronic device 400. At least one of the components of the electronic device 400 may be the same as or similar to at least one of the components of the electronic device 300 of FIG. 3A or 3B, and a repeated description thereof will be omitted.

The first support member 411 may be disposed in the interior of the electronic device 400 to be connected to the side bezel structure 410 or to be integrally formed with the side bezel structure 410. The first support member 411, for example, may be formed of a metallic material and/or a nonmetallic material (e.g., a polymer). The display 430 may be coupled to one surface of the first support member 411, and the printed circuit board 440 may be coupled to an opposite surface of the first support member 311. A processor, a memory, and/or an interface may be mounted on the printed circuit board 440. The processor, for example, may include one or more of a central processing unit, an application processor, a graphic processing unit, an image signal processor, a sensor hub process, or a communication processor.

The memory, for example, may include a volatile and/or nonvolatile memory.

The interface, for example, may include a high definition multimedia interface (HDMI), a universal serial bus (USB), an SD card interface, and/or an audio interface. The interface, for example, may electrically or physically connect the electronic device 400 to an external electronic device, and may include a USE connector, an SD card/MMC connector, and an audio connector.

The battery 450 is a device for supplying electric power to at least one component of the electronic device 400, and for example, may include a primary battery that cannot be recharged, a secondary battery that may be recharged, or a fuel cell. At least a portion of the battery 450, for example, may be disposed on substantially the same plane as the printed circuit board 440. The battery 450 may be integrally disposed in the interior of the electronic device 400, and may be disposed to be detachable from the electronic device 400.

The second support member 460 may be coupled to the first support member 411, and may be disposed between the printed circuit board 440 and the rear plate 480. The second support member 460 may be coupled to the first support member 411 together with the printed circuit board 440 by using bolting, and may function to protect the printed circuit board 440 by covering the printed circuit board 440.

The antenna 470 may be disposed between the rear plate 480 and the battery 450. The antenna 470, for example, may include a near field communication (NFC) antenna, a wireless charging antenna, and/or a magnetic secure transmission (MST) antenna. The antenna 470, for example, may perform short-range communication with an external device, or may wirelessly transmit and receive electric power that is necessary for charging. In another embodiment, an antenna structure may be formed by one or a combination of the side bezel structure 410 and/or the first support member 411.

According to an embodiment, the electronic device 400 may include a header connector (e.g., the header connector 100 of FIG. 1A) and a socket connector (e.g., the socket connector 200 of FIG. 2A). According to an embodiment, the header connector and the socket connector may be coupled to the elements of the printed circuit board 440, and the display 330 electrically connected to the printed circuit board 440. For example, the header connector and the socket connector may be utilized to electrically connect the display 330 and the printed circuit board 340. For example, the header connector and the socket connector may be utilized to electrically connect the camera module and the printed circuit board 340. It is apparent that the header connector and the socket connector may be utilized for electrical connection of various other elements.

According to various embodiments, the electronic device may further include various elements (or modules) according to the provided forms thereof. The elements are very variously modified according to the convergence trend of digital devices and all of them cannot be enumerated, but the elements of the same level as the above-mentioned elements may be additionally included in the electronic device. It is apparent that in the electronic device according to various embodiments, specific elements may be excluded from the above elements or some elements may be replaced by other elements.

An electronic device according to various embodiments disclosed herein may be various types of devices. The electronic devices, for example, may include at least one of a portable communication device (e.g., a smart phone), a computer device, a portable multimedia device, a portable medical device, a camera, a wearable device, or a home appliance. The electronic device according to the embodiment of the disclosure is not limited to the aforementioned devices. The term "user" used herein may refer to a person who uses an electronic device or may refer to a device (e.g., an artificially intelligent electronic device) that uses an electronic device.

In various embodiments, the electronic devices may include accessories (e.g., watches, rings, bracelets, ankle bracelets, glasses, contact lenses, or head-mounted devices (HMDs)), cloth-integrated types (e.g., electronic clothes), body-attached types (e.g., skin pads or tattoos), or implantable types (e.g., implantable circuits). In some embodiments, the home appliances may include, for example, at least one of a television, a digital video disk (DVD) player, an audio, a refrigerator, an air conditioner, a cleaner, an oven, a microwave oven, a washing machine, an air cleaner, a set-top box, a home automation control panel, a security control panel, a TV box (e.g., Samsung HomeSync™, Apple TV™, or Google TV™), a game console (e.g., Xbox™ or PlayStation™), an electronic dictionary, an electronic key, a camcorder, or an electronic panel.

In another embodiment of the disclosure, the electronic device may include at least one of various medical devices (e.g., various portable medical measurement devices (a blood glucose meter, a heart rate measuring device, a blood pressure measuring device, and a body temperature measuring device), a magnetic resonance angiography (MRA), a magnetic resonance imaging (MRI) device, a computed tomography (CT) device, a photographing device, and an ultrasonic device), a navigation system, a global navigation satellite system (GNSS), an event data recorder (EDR), a flight data recorder (FDR), a vehicular infotainment device, electronic devices for vessels (e.g., a navigation device for vessels and a gyro compass), avionics, a security device, a vehicular head unit, an industrial or home robot, a drone, an automatic teller machine (ATM) of a financial company, a point of sales (POS) of a store, or an internet of things (e.g., a bulb, various sensors, a spring cooler device, a fire alarm device, a thermostat, an electric pole, a toaster, a sporting apparatus, a hot water tank, a heater, and a boiler). According to some embodiments of the disclosure, the electronic device may include at least one of furniture or a part of a building/structure or a vehicle, an electronic board, an electronic signature receiving device, a projector, or various measurement devices (e.g., a water service, electricity, gas, or electric wave measuring device). In various embodiments of the disclosure, the electronic device may be flexible or may be two or more combinations of the various devices. The electronic device according to the embodiment of the disclosure is not limited to the aforementioned devices. The term "user" used herein may refer to a person who uses an electronic device or may refer to a device (e.g., an artificially intelligent electronic device) that uses an electronic device.

According to an embodiment, an electronic device (e.g., the electronic device 300 of FIG. 3A) may include a connector (e.g., the header connector 100 of FIG. 1A or the socket connector 200 of FIG. 2A), and a printed circuit board, on which the connector 100 or 200 is mounted. The connector 100 or 200 may include a nonconductive structure (e.g., the first structure 110 or the second structure 210) including a plate (e.g., the first plate 111 or the second plate 121) including a first surface (e.g., the first surface 101 or the eleventh surface 2011) and a second surface (e.g., the second surface 102 or the twelfth surface 2012) facing a side that is opposite to a side which the first surface 101 or 2011 faces, a first side wall (e.g., the first side wall 112 or the eleventh side wall 212) that is perpendicular to the plate 111 or 211, a second side wall (e.g., the second side wall 113 or the twelfth side wall 213) that is perpendicular to the first side wall 112 or 212 and the plate 111 or 211, a third side wall (e.g., the third side wall 114 or the thirteenth side wall 214) that is perpendicular to the first side wall 112 or 212 and the plate 111 or 211 and is parallel to the second side wall 113 or 213, and a fourth side wall (e.g., the fourth side wall 115 or the fourteenth side wall 215) that is perpendicular to the plate 111 or 211 and is parallel to the first side wall 112 or 212. The structure 110 or 210 may include a recess 150 or 250 defined by the first surface 101 or 2011 of the plate 110 or 210, the first side wall 112 or 212, the second side wall 113 or 213, the third side wall 114 or 214, and the fourth side wall 115 or 215. The electronic device 300 may include a plurality of conductive terminals 120 or 220 coupled to the second side wall 113 or 213 and the third side wall 114 or 214 and electrically connected to the printed circuit board. The electronic device 300 may include an integral metal plate (e.g., the metal member 141, 142, 291, or 292) configured to cover at least one surface of the first side wall 112 or 212 or the fourth side wall 115 or 215). The first side wall 112 or 212 or the fourth side wall 115 or 215 may include a third surface (e.g., the third surface 103 or the thirteenth surface 2013) defining the recess 150 or 250, a fourth surface (e.g., the fourth surface 104 or the fourteenth surface 2014) facing a side that is o opposite to a side which the third surface 103 or 2013 faces, a sixth surface (e.g., the sixth surface 106 or the sixteenth surface 2016) defining a rear surface of the structure 110 or 210 together with the second surface 102 or 2012, and a fifth surface (e.g., the fifth surface 105 or the fifteenth surface 015) facing a side that is opposite to a side which the sixth surface 106 or 2016 faces. The metal plate 141, 142, 291, or 292 may cover the third surface 103 or 2013 and the fifth surface 105 or 2015.

According to an embodiment, the metal plate 141, 142, 291, or 292 may further cover the fourth surface 104 or 2014.

According to an embodiment, the first side wall 112 or 212 or the fourth side wall 115 or 215 may further include a seventh surface 107 and an eighth surface 108 defining a side surface of the structure 110 or 210 together with the fourth surface 104 or 2014 and disposed on opposite sides. The metal plate 141 and 142 may cover the seventh surface 107 or the eighth surface 108.

According to an embodiment, the metal plate 141, 142, 291, or 292 may further include a part (e.g., the area 149)

extending to the outside of the structure 110 or 210 and coupled to the printed circuit board.

According to an embodiment, the metal plate 141, 142, 291, or 292 may further cover a portion of the first surface 101 or 2012.

According to an embodiment, the structure 210 may further include a protrusion 216 disposed in the recess 250 and surrounded by the first side wall 212, the second side wall 213, the third side wail 214, and the fourth side wall 215. The protrusion 216 may be disposed to be spaced apart from the first side wall 212, the second side wall 213, the third side wall 214, and the fourth side wall 215 with a spacing space interposed therebetween.

According to an embodiment, the protrusion 216 may include a seventh surface (e.g., the seventeenth surface 2017) facing the o third surface 2013 and an eighth surface (e.g., the eighteenth surface 2018) facing a side that is opposite to a side which the second surface 2012 faces. The metal plate 291 or 292 may cover the seventh surface 2017 and the eighth surface 2018.

According to an embodiment, the metal plate 291 or 292 may further cover an area of the first surface 2011 that is between the seventh 2017 and the eighth surface 2018.

According to an embodiment, the second side wall 213 or the third side wall 214 may include a ninth surface (e.g., the nineteenth surface 2019) defining the recess 250, a tenth surface (e.g., the twentieth surface 2020) facing a side that is opposite to a side which the ninth surface faces, a twelfth surface (e.g., the twenty second surface 2022) defining a rear surface of the structure 210 together with the second surface 2012, and an eleventh surface (e.g., the twenty first surface 2021) facing a side that is opposite to a side which the twelfth surface 2022 faces. The metal plate 291 or 292 may cover the ninth surface 2019 and the eleventh surface 2021.

According to an embodiment, the printed circuit board may include a rigid printed circuit board or a flexible printed circuit board.

According to an embodiment, the metal plate 141, 142, 291, or 292 may be electrically connected to the printed circuit board.

According to an embodiment, the metal plate 141, 142, 291, or 292 is utilized as an electrical path for transmitting electric power.

According to an embodiment, the metal plate 141, 142, 291, or 292 may be electrically connected to a circuit related to a pull-down resistor or a pull-up resistor mounted on the printed circuit board.

According to an embodiment, the connector may include a header connector 100 or a socket connector 200.

According to an embodiment, the connector (e.g., the header connector 100 of FIG. 1A or the socket connector 200 of FIG. 2A) is electrically connected to a display 330 or a camera module included in the electronic device 300.

The disclosure has been described above by way of exemplary embodiments. Those skilled in the art will appreciate that various modifications and changes may be made without departing from the essential spirit and scope of the disclosure. Therefore, the embodiments disclosed herein should be considered not from limitative viewpoints but from illustrative viewpoints. The scope of the disclosure should be determined not by the above description but by the appended claims, and all differences equivalent to the claims shall be construed as falling within the scope of the disclosure.

The invention claimed is:

1. An electronic device comprising:

a connector; and a printed circuit board, on which the connector is mounted, wherein the connector comprises:

a nonconductive structure comprising a plate comprising a first surface and a second surface facing a side that is opposite to a side which the first surface faces, a first side wall that is perpendicular to the plate, a second side wall that is perpendicular to the first side wall and the plate, a third side wall that is perpendicular to the first side wall and the plate and is parallel to the second side wall, and a fourth side wall that is perpendicular to the plate and is parallel to the first side wall, and having a recess defined by the first surface of the plate, the first side wall, the second side wall, the third side wall, and the fourth side wall;

a plurality of conductive terminals coupled to the second side wall and the third side wall and electrically connected to the printed circuit board; and a metal plate configured to cover at least one surface of the first side wall or the fourth side wall, wherein the first side wall or the fourth side wall comprises a third surface defining the recess, a fourth surface facing a side that is opposite to a side which the third surface faces, a sixth surface defining a rear surface of the structure together with the second surface, and a fifth surface facing a side that is opposite to a side which the sixth surface faces, wherein the metal plate covers the third surface and the fifth surface, and wherein the metal plate comprises a first part covering the fourth surface and a second part adjacent to the first part and covering the sixth surface.

2. The electronic device of claim 1, wherein the first side wall or the fourth side wall further comprises a seventh surface and an eighth surface defining a side surface of the structure together with the fourth surface and disposed on opposite sides, and wherein the metal plate covers the seventh surface or the eighth surface.

3. The electronic device of claim 1, wherein the metal plate further comprises a part extending to the outside of the structure and coupled to the printed circuit board.

4. The electronic device of claim 1, wherein the metal plate further covers a portion of the first surface.

5. The electronic device of claim 1, wherein the structure further comprises a protrusion disposed in the recess and surrounded by the first side wall, the second side wall, the third side wall, and the fourth side wall, and wherein the protrusion is disposed to be spaced apart from the first side wall, the second side wall, the third side wall, and the fourth side wall with a spacing space interposed therebetween.

6. The electronic device of claim 5, wherein the protrusion comprises a seventh surface facing the third surface and an eighth surface facing a side that is opposite to a side which the second surface faces, and wherein the metal plate covers the seventh surface and the eighth surface.

7. The electronic device of claim 6, wherein the metal plate further covers an area of the first surface that is between the seventh and the eighth surface.

8. The electronic device of claim 5, wherein the second side wall or the third side wall comprises a ninth surface defining the recess, a tenth surface facing a side that is opposite to a side which the ninth surface faces, a twelfth surface defining a rear surface of the structure together with the second surface, and an eleventh surface facing a side that is opposite to a side which the twelfth surface faces, and wherein the metal plate covers the ninth surface and the eleventh surface.

9. The electronic device of claim 1, wherein the printed circuit board comprises a rigid printed circuit board or a flexible printed circuit board.

10. The electronic device of claim 1, wherein the metal plate is electrically connected to the printed circuit board.

11. The electronic device of claim 10, wherein the metal plate is utilized as an electrical path for transmitting electric power.

12. The electronic device of claim 10, wherein the metal plate is electrically connected to a circuit related to a pull-down resistor or a pull-up resistor mounted on the printed circuit board.

13. The electronic device of claim 1, wherein the connector comprises a header connector or a socket connector.

14. The electronic device of claim 1, wherein the connector is electrically connected to a display or a camera module included in the electronic device.

* * * * *